United States Patent [19]

Brown

[11] 4,084,347

[45] Apr. 18, 1978

[54] HIGH IMPACT RESISTANCE DOOR

[76] Inventor: James W. Brown, 1612 Canyon Park Dr., Bend, Oreg. 97701

[21] Appl. No.: 670,295

[22] Filed: Mar. 25, 1976

Related U.S. Application Data

[63] Continuation-in-part of Ser. No. 489,861, Jul. 19, 1974, abandoned.

[51] Int. Cl.[2] ..... E05D 7/00

[52] U.S. Cl. ..... 49/397; 49/368; 49/388; 49/488; 49/501

[58] Field of Search ..... 49/397, 398, 366, 368, 49/501, 503, 388, 389, 34, 488, 9; 52/405, 615; 160/354

[56] References Cited

U.S. PATENT DOCUMENTS

| | | | |
|---|---|---|---|
| 1,701,214 | 2/1929 | Raymond | 49/488 |
| 2,930,086 | 3/1960 | Griffiths | 49/503 X |
| 3,056,475 | 10/1962 | Benham | 49/501 |
| 3,142,095 | 7/1964 | Sawyer | 49/366 |
| 3,161,925 | 12/1964 | Bertolini | 49/368 |
| 3,320,699 | 5/1967 | Carson et al. | 49/399 X |
| 3,384,996 | 5/1968 | Gilchrist et al. | 49/488 X |
| 3,407,536 | 10/1968 | Nystrom | 49/488 X |
| 3,498,001 | 3/1970 | MacDonald | 49/501 |
| 3,885,351 | 5/1975 | Imperial et al. | 49/501 |
| 3,950,894 | 4/1976 | DiMaio | 49/501 |

*Primary Examiner*—Philip C. Kannan

[57] ABSTRACT

An improved door suitable for use in industrial plants and other such areas where the door is to be opened and closed by objects or vehicles which strike the side of the door. The door has a hollow body provided with a monolithic construction and is formed from a moldable material which is highly resistant to impact forces exerted thereon. The body is filled with a foamed-in-place insulating material and has reinforcing means at spaced locations therein to maintain the shape of the door. Gasket structure is used at one or more margins of the door, and the door is to be swingably mounted on an adjacent door jamb.

10 Claims, 7 Drawing Figures

FIG. 3
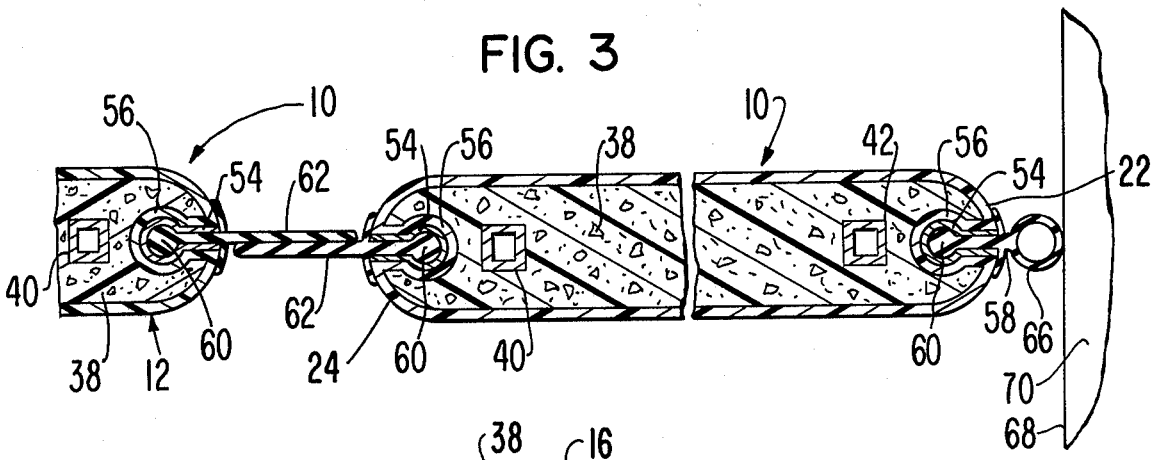
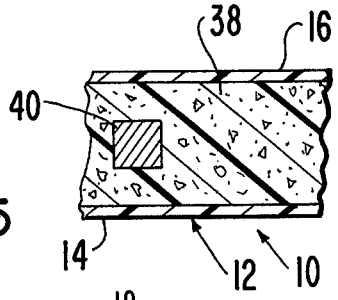
FIG. 3a
FIG. 5
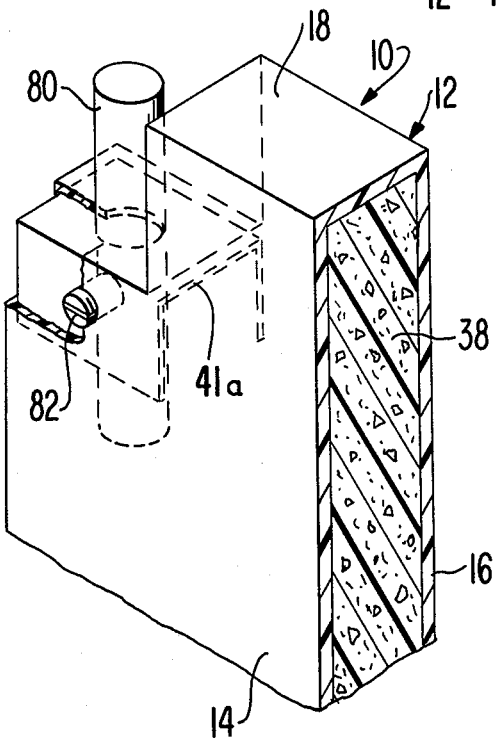
FIG. 6
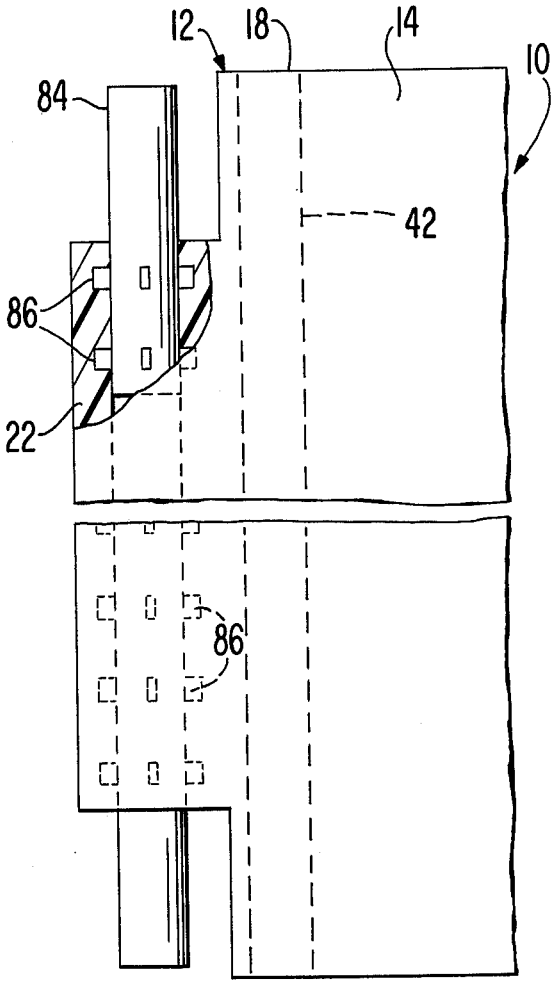

HIGH IMPACT RESISTANCE DOOR

This application is a continuation-in-part application of U.S. application, Ser. No. 489,861, filed July 19, 1974, now abandoned.

This invention relates to improvements in industrial-type doors and, more particularly, to a one-piece door of high resistant plastic material.

BACKGROUND OF THE INVENTION

In many industrial plants, hospitals and other such locations, swinging doors are used in doorways through which both vehicular and foot traffic passes. Oftentimes, the doors in these places are swung to open positions by moving a vehicle, such as a forklift truck, gurney or the like against the door rather than manually pushing the door to an open position. Under these circumstances, the door must be extremely durable and preferably lightweight in construction. The door must be durable so that it will not be damaged to any appreciable extent when subjected to impact forces by vehicles and the like and it must be lightweight in construction so that a minimum force is required to swing the door to an open position.

Conventional industrial doors are made by a number of companies. A typical door of this type is made and sold by RubbAir Door, a division of Eckel Industries, Inc., Cambridge, Massachusetts. The RubbAir door, for instance, has a base provided with processed rubber facings secured thereto so that the door will absorb the shock of impact forces exerted thereon. However, such a door construction requires fastening means between the base material and the rubber facings so as to give rise to possible separation of the facings from the base. This requires maintenance and could even require frequent replacement of the door.

A number of U.S. patents have been directed to panel or door construction for industrial and other types of applications. For instance, U.S. Pat. No. 3,634,971 shows the construction of a refrigerator door using a thermal insulating material within hollow shell. However, the shell is not monolithic in construction. It is made of formed or stamped sheet metal which must be joined at a pair of opposed edges thereof to present the door itself. Moreover, such a door is not adapted to withstand much rough handling and abuse as is required in industrial plants and installations where doors are opened by impact forces exerted by vehicles.

Other publications relating to molded panels or doors include U.S. Pat. Nos. 3,142,095; 3,498,001; and 3,753,843. U.S. Pat. No. 3,142,095 does not teach or suggest a door adapted for heavy-duty industrial applications. Similarly, the other two patents fail to teach a door constructed to meet the demands of such applications. U.S. Pat. No. 3,498,001 shows a two-piece hollow panel that can be separated; and U.S. Pat. No. 3,753,843 shows a panel having a honeycomb core but the panel body is molded onto the core rather than being molded before placement of the core therein, thereby keeping production costs relatively high, yet the panel is not suggested for use as a heavy-duty industrial door.

SUMMARY OF THE INVENTION

The present invention is directed to an improved industrial-type door which is constructed in a manner to allow the door to be used as a swinging closure in environments where relatively high magnitude impact forces are likely to be exerted on the door. To this end, the door of this invention is of a monolithic construction and is formed by a rotatable molding process from a moldable plastic material which, in a solidified condition, has a high resistance to abrasion, shock forces and the like. The door is hollow and is filled with a foam material which is foamed in place. Thus, the door is suitable for use in refrigeration plants as well as in installations separating two spaces through which vehicular traffic passes.

The door, because of its monolithic plastic construction, is highly resistant to denting, puncturing or scratching due to impact thereon by carts, forklifts and other mechanical vehicles or equipment which engage the door to open the same, and will not separate or fall apart as a result of such use. The door, because of its plastic construction, can also be made highly resistant to acids, petroleum products, animal fats, vermin, insects, moisture, salt water, and other chemicals of many different types. Moreover, the door can be readily cleaned and rendered sanitary for use in food service areas and hospital regions. The door can be made of lightweight material so that the door can be moved in stacked relationship with other such doors and, by virtue of the stacking of the doors, a large number of doors can be stored in a minimum of space.

The door may be reinforced by the use of a pair of rigid rods which extend the length of the door at spaced locations therein. The rods keep the door from bowing and maintain its shape even against relatively high impact forces exerted on the door.

The door can also be provided with gasket structure on one or more margins thereof to permit the door to be used where insulation of one space from another is required. To this end the door may be provided with a permanent keyway molded in the door itself to permit replacement of gaskets when such action becomes necessary.

The primary object of this invention is to provide an improved door formed from a moldable plastic material and having a one-piece construction wherein the door is extremely durable and resistant to impact forces exerted thereon so that it will stand up to abuse without being separated, punctured or otherwise damaged when engaged by movable objects, such as carts, forklifts and other such vehicular equipment.

Another object of this invention is to provide a door of the type described which is hollow in construction and is provided with foamed-in-place thermal insulating material therewithin and gasket structure at certain margins thereof, so that the door is suitable for a wide variety of uses, including use as a refrigerator door, yet it retains its inherent resistance to abuse and rough handling, such as by impact forces randomly exerted at various locations thereon.

Other objects of this invention will become apparent as the following specifications progresses, reference being had to the accompanying drawings for an illustration of the invention.

IN THE DRAWINGS

FIG. 3 is an enlarged cross-sectional view taken along line 3—3 of FIG. 1;

Figure 4:
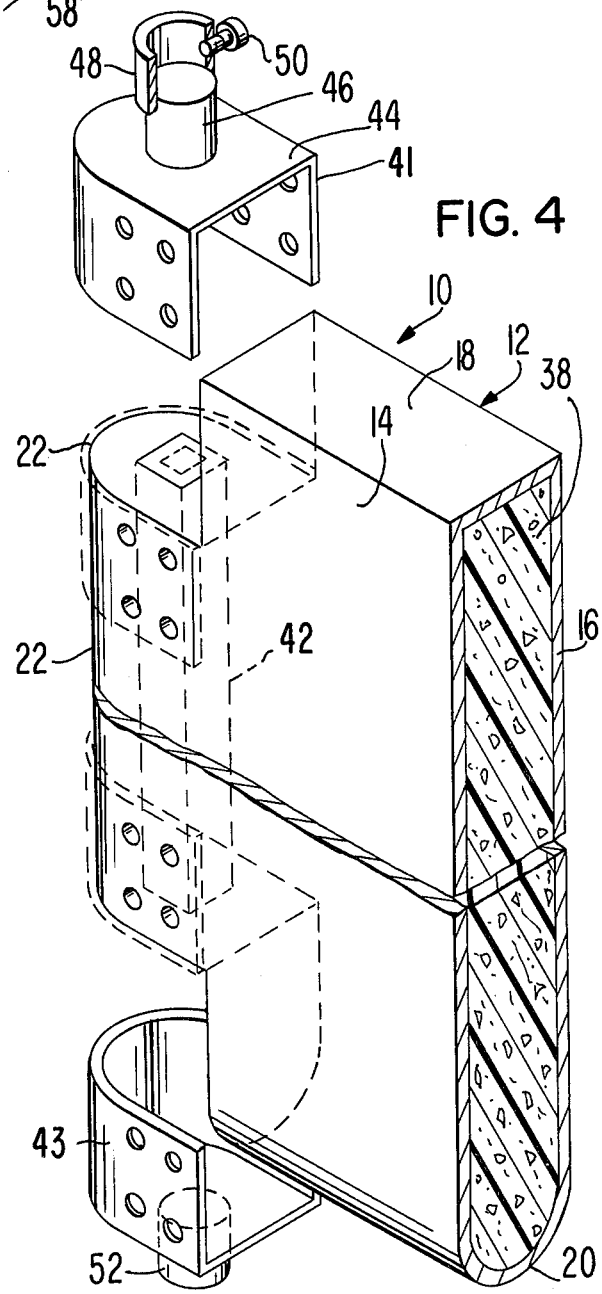

FIG. 3*a* is a view similar to FIG. 3 but showing another type of reinforcing rod in the door;

FIG. 4 is an enlarged, fragmentary perspective view of a side margin of the door showing one embodiment of the hinge mount thereof; and FIGS. 5 and 6 are views similar to FIG. 4 but showing other embodiments of the hinge mount.

The door which is the subject of this invention is broadly denoted by the numeral 10 and is illustrated in detail in FIGS. 1–4. Door 10 includes a hollow body 12 of monolithic construction. It has a pair of opposed sidewalls 14 and 16, a flat top wall 18, a convex bottom wall 20, and a pair of opposed vertical end walls 22 and 24 at side margins of sidewalls 14 and 16. Body 12 is formed in a rotatable molding process so that walls 14, 16, 18, 20, 22, and 24 are integral with each other and there are no seams at the junctions of the various walls. Door 10 also has a window opening 26 (FIGS. 1 and 2) with the opening being defined by a transversely U-shaped, continuous member 28 as shown on FIG. 2, member 28 being integral with continuous side flanges 30, the flanges also being integral with side-walls 14 and 16. Member 28 and flanges 30 are formed at the same time that the other portions of the door are formed.

The door is formed from a suitable moldable material adapted when solidified, to withstand high impact forces and shocks exerted thereon. Suitable material for this purpose is cross-linked high density polyethylene. The door has a typical wall thickness of approximately $\frac{1}{8}$ inch and an overall thickness of about $1\frac{7}{8}$ inches. The door can have a textured outer finish on sidewalls 14 and 16. This monolithic construction of the door eliminates moisture penetration into the same and prevents the collection of dirt and the possibility of delamination.

Bottom wall 20 and end walls 22 and 24 are rounded or convex to prevent wear on these portions. A typical radius of the curvature of these parts is 15/16 inch.

Window opening 26 is provided with a pair of panes 32, preferably of $\frac{1}{8}$ inch of polycarbonate material having an abrasion resistant surface. Panes 32 are attached in any suitable manner, such as by a calking material 34 to member 28 to form an air space 36 between the panes to help prevent fogging and condensation on the same. The panes are recessed with respect to sidewalls 14 and 16 to prevent equipment and loads from coming in contact with the surfaces of the panes. A single pane could be utilized if control of thermal conductivity is not required. The panes can be eliminated altogether if control of draft, noise, dust or fumes is not required.

The door is filled with a high density, applied-in-place insulating material such as urethane or the like. The material, denoted by the numeral 38, is blown in through a hole (not shown) drilled in a wall of the door and the material is bonded to the inner surfaces of the various parts of the door to provide it with structural strength and thermal insulation. Typically, the thermal conductivity of the material will be in the region of 0.15BTU/hr/ft and a coefficient of heat transfer shall not exceed 0.075 which is comparable to $3\frac{1}{2}$ inches of polystyrene or fiberglass.

Figure 1:
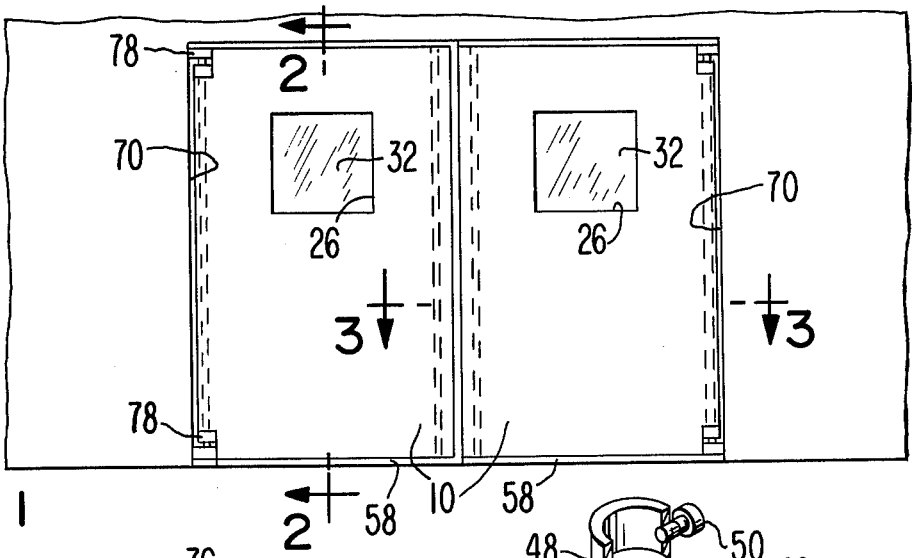
FIG. 1 is a side elevational view of a pair of swingably mounted doors made in accordance with this invention and positioned to close a doorway.

To reinforce door 10 and to help it withstand impact forces, a pair of relatively rigid rods 40 and 42 are provided lengthwise of the door as shown in FIGS. 1, 3 and 4. These rods prevent bowing of the door and help to keep it from losing its shape. For purposes of illustration, these rods are of steel, have a square cross section and are tubular. Rod 42 is located as shown in FIG. 4 adjacent to and spaced inwardly from wall 22; the other rod 40 is near wall 24 as shown in FIG. 3. These rods extend substantially the vertical length of door 10 but at least throughout a major portion of such length.

The upper and lower corners of the door adjacent to wall 22 are notched to accommodate hinge structure for mounting door 10 on an adjacent jamb. The door has a pair of brackets 41 and 43 for the upper and lower notches, respectively, as shown in FIG. 4. Each of these brackets is adapted to complementally fit onto the door in the manner shown in dashed lines in FIG. 4, each bracket having a flat part 44 provided with a stub shaft 46 welded or cast thereto. A sleeve 48 can be mounted onto shaft 46 and secured thereto by a set screw 50 so that hinge structure can be mounted on sleeve 48 for attaching the door to an adjacent jamb. Bracket 43 has a stub shaft 52 for the same purpose as stub shaft 46.

When brackets 41 and 43 are put in place, they are secured by screws or other fasteners to the adjacent portions of rod 42. Thus, the rod also acts as an anchor for securing the brackets in place.

Figure 2:
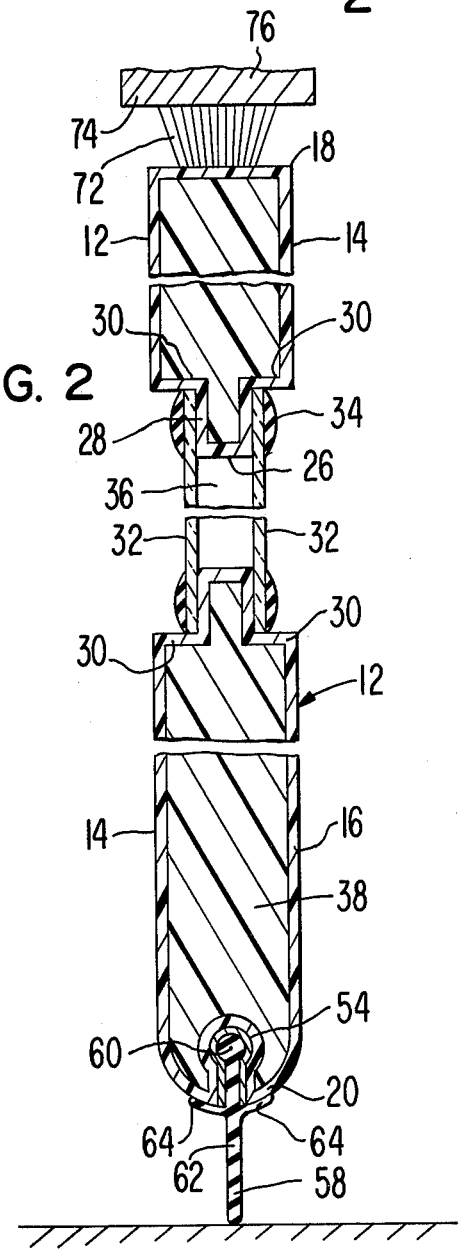
FIG. 2 is an enlarged cross-sectional view taken along line 2—2 of FIG. 1.

Certain margins of door 10 can be provided with gasket structure for sealing or insulation purposes. For instance, as shown in FIGS. 2 and 3, bottom wall 20 and vertical end walls 22 and 24 are provided with respective gaskets. To this end, each of the margins adjacent to these walls is provided with a keyway-forming member 54 of a suitable material, such as aluminum or the like, the member being permanently mounted to the door and being molded therein. Each member 54 is surrounded by transversely key-shaped shroud 56 integral with the adjacent wall and formed when the other walls of the door are formed.

For each member 54, there is provided a gasket 58 of a suitable material, such as neoprene or the like, the gasket having a bead 60 and a flexible blade 62 for insertion into the corresponding member 54. A pair of spaced flanges 64 are adapted to engage the adjacent outer surface portions of the corresponding wall. Gasket 58 for wall 22 has a tubular outer bead 66 for engaging the adjacent surface 68 of the corresponding jamb 70.

Top wall 18 is adapted to cooperate with a gasket 72 carried by and depending from flat surface 74 of a top jamb 76, when the door is mounted in an operating position.

Top wall 18 could be rounded as discussed above with respect to bottom wall 20 and could also be provided with a gasket, such as gasket 58, as previously described.

One particular use of door 10 is illustrated in a door assembly in FIG. 1, wherein a pair of such doors 10 are swingably mounted for rotation about vertical axes adjacent to door jamb 70. Each door is identical in construction and is provided with gaskets 58 as mentioned above. The doors are adapted to close an opening spanning the distance between jambs 70 and, to this end, hinge structure 78 is provided at the upper and lower ends of each door 10 respectively adjacent to the notches thereof. The doors have gaskets 58 whose flexible outer portions overlap in the manner shown in FIG. 3 at the center of the assembly, the flexibility of the gaskets being sufficient to allow either door to readily move in opposite directions relative to the other door.

The door assembly shown in FIG. 1 can be subjected to high impact forces or shocks by forklift trucks and the like without being subjected to damage. Moreover, the doors can be used in an environment where there is a temperature gradient between the space on one side of the door and a space on the opposite side of the door. The construction also deadens noises and effectively isolates the spaces from each other.

Other embodiments of the hinge mounts for the door are illustrated in FIGS. 5 and 6. In FIG. 5, the bracket 41*a* is embedded in the door adjacent to end wall 22 thereof during the molding of the door. The end wall is shown as being flat and the bracket has wear sides to illustrate that the end wall and the bracket need not be curved as shown in FIG. 4. A stub shaft 80 extends through the upper part 82 of member 41*a* and is held in place by one or more set screws 82 accessible from one or both side of the door. The stub shaft will extend upwardly or downwardly from the adjacent notch from the door so that hinge structure can be mounted thereon. A suitable hinge will be one known as Gravity Hinge No. 192 made by Kason Co. Binghamton, New York. In FIG. 5, rod 42 is omitted but it is to be understood that the rod would normally be in place there as shown in FIG. 4 or at a location slightly spaced therefrom.

Another form of the hinge mount of the door is shown in FIG. 6 wherein a shaft 84 is embedded in the door adjacent to end wall 22. Shaft 84 has lateral projections 86 thereon extending into the moldable material of the door to prevent rotation of the shaft relative to the door. To this end, the part of the door through which shaft 84 extends is solid material, rather than hollow and filled with insulating material as shown in FIG. 4. Reinforcing rod 42 is shown adjacent to the notches in the door into which the ends of shaft 84 project.

A suitable material for door 10 has been found to be one identified as Marlex CL-100, Rotational Molding Cross-linkable High Density Polyethylene supplied by Phillips Petroleum Co., Plastics Services Division, Bartlesville, Oklahoma. Other parameters of this material are as follows: abrasion resistance, 5%; compressive strain, 8.1% at 2,000 psi; Durometer hardness, 68 to 70; elongation, 450%; tensile strength, and temperature range, −40° to 225° F.

What is claimed is:

1. An industrial door adapted for use in environments which require the door to be subjected to impact forces exerted thereon comprising: a hollow body of a molded plastic material having the characteristic of being relatively highly resistant to an impact force exerted on the body, said body being formed from said material in a single molding process to present a pair of spaced vertical sidewalls, a top wall, a bottom wall and a pair of opposed vertical end walls interconnecting the top and bottom walls, the sidewalls, the top and bottom walls, and the end walls being integral with each other to present a monolithic construction for the body; a mass of applied-in-place insulating material within said body and bonded to the inner surfaces of said sidewalls and said top, bottom and end walls; and rod means embedded within said insulating material mass and spaced inwardly from said sidewalls and said end walls for reinforcing said body, there being means adjacent to one end wall for mounting hinge structure on the body, whereby the body can be swingably mounted on a door jamb.

2. A door as set forth in claim 1, wherein certain of the walls have gasket structure thereon, said structure including a gasket for each of said certain walls, each gasket having a bead at one margin thereof and a blade at its opposite margin, and a keyway-forming member on each of said certain walls, respectively, the bead and one margin of each gasket being received within the corresponding member.

3. A door as set forth in claim 1, wherein said rod means includes a pair of spaced rods extending longitudinally of said end walls throughout at least a major part of the height of said body.

4. A door as set forth in claim 3, wherein the rods are solid.

5. A door as set forth in claim 3, wherein said rods are tubular.

6. A door as set forth in claim 3, wherein one of said rods is adjacent to and spaced inwardly from said one end wall, said mounting means being coupled to the opposed ends of said one rod and being anchored thereby.

7. A door as set forth in claim 1, wherein said mounting means includes a pair of rigid members for the top and bottom, respectively, of said body, each member being in the plane of the body and having a shaft projecting outwardly therefrom longitudinally of said one end wall.

8. A door as set forth in claim 7, wherein each member is exterior of the body.

9. A door as set forth in claim 7, wherein each member is embedded in the sidewalls and said one end wall.

10. An industrial door adapted for use in environments which require the door to be subjected to impact forces exerted thereon comprising: a hollow body of a moldable plastic material having the characteristic of being relatively highly resistant to an impact force exerted on the body, said body being formed from said material in a rotatable molding process to present a pair of spaced vertical, flat sidewalls, a top wall, a bottom wall and a pair of opposed vertical end walls interconnecting the top and bottom walls, the sidewalls, the top and bottom walls, and the end walls being integral with each other to present a monolithic construction for the body; a mass of insulating material filling the interior of the body and bonded to the inner surfaces of the sidewalls and the top, bottom and end walls to provide thermal insulation for the body; and a pair of spaced, rigid rods embedded in said insulating material mass in inwardly spaced relationship to the sidewalls and the end walls for reinforcing the body; means adjacent to one vertical end wall for mounting hinge structure on the body, whereby the body can be swingably mounted on a door jamb; and a gasket for each of said bottom wall and said vertical end walls, respectively, said body having a keyway-forming member for each gasket, respectively, the keyway-forming members being embedded in the corresponding walls and removably receiving portions of respective gaskets.

* * * * *